US005667638A

United States Patent [19]

Dragner et al.

[11] Patent Number: 5,667,638

[45] Date of Patent: Sep. 16, 1997

[54] METHOD OF ENHANCING THE OPACITY OF PRINTING PAPERS AND PAPER PRODUCED THEREOF

[75] Inventors: Louis Robert Dragner; Bernard North, both of Rock Hill, S.C.

[73] Assignee: Sequa Chemicals, Inc., Chester, S.C.

[21] Appl. No.: 722,777

[22] Filed: Sep. 27, 1996

Related U.S. Application Data

[60] Continuation of Ser. No. 438,075, May 8, 1995, abandoned, which is a division of Ser. No. 213,045, Mar. 15, 1994, abandoned.

[51] Int. Cl.[6] ..... D21H 17/07; D21H 23/00

[52] U.S. Cl. ..... 162/158; 162/179

[58] Field of Search ..... 162/158, 179, 162/166, 181.1, 164.6; 106/243, 179, 203

[56] References Cited

U.S. PATENT DOCUMENTS

| | | | |
|---|---|---|---|
| 3,554,862 | 1/1971 | Hervey et al. | 162/158 |
| 4,348,257 | 9/1982 | Maslanka et al. | 162/162 |
| 4,431,481 | 2/1984 | Drach et al. | 162/100 |
| 4,447,294 | 5/1984 | Osboro, III | 162/158 |
| 4,452,934 | 6/1984 | Swafford | 524/243 |
| 4,643,919 | 2/1987 | Fu | 252/8.7 |
| 4,769,159 | 9/1988 | Copeland | 252/8.8 |
| 4,772,404 | 9/1988 | Fox et al. | 252/8.8 |
| 4,786,367 | 11/1988 | Bogart et al. | 162/158 |
| 4,874,466 | 10/1989 | Savino | 162/164.3 |
| 4,892,663 | 1/1990 | Keys | 210/729 |
| 5,225,047 | 7/1993 | Graef et al. | 162/9 |
| 5,240,562 | 8/1993 | Phan et al. | 162/158 |
| 5,296,024 | 3/1994 | Hutcheson | 106/243 |
| 5,332,473 | 7/1994 | Ferguson | 162/164.1 |

*Primary Examiner*—Donald E. Czaja
*Assistant Examiner*—Jose A. Fortuna
*Attorney, Agent, or Firm*—Mitchell D. Bittman

[57] ABSTRACT

A chemical composition for use in the papermaking process to produce a paper having enhanced opaqueness is provided. The process using the composition to make the paper and the paper made therefrom are also provided by the present invention. The composition contains an alkyl bis (alkyl amido alkyl)-2-hydroxy alkyl ammonium alkyl salt.

17 Claims, No Drawings

METHOD OF ENHANCING THE OPACITY OF PRINTING PAPERS AND PAPER PRODUCED THEREOF

This is a continuation of application Ser. No. 08/438,075, filed May 08, 1995, now abandoned which is a division of application Ser. No. 08/213,045, filed Mar. 15, 1994, now abandoned.

FIELD OF THE INVENTION

This invention relates to compositions for use in the papermaking process, a papermaking process employing the compositions to add opaqueness to the paper, and a paper produced using the compositions.

BACKGROUND OF THE INVENTION

The quality of paper produced from cellulose fibers (i.e. wood pulp or the paper produced by the recycling of such paper) is often judged by its opacity. Paper producers have long sought to improve opacity so that an enhanced paper may be obtained.

This and other desired characteristics have been obtained in the past by supplying the pulp slurry of cellulose fibers or furnish with additives prior to the slurry entering the papermaking machine. Various additives are well known in the art. For example, titanium dioxide powder is known to be an excellent whitener. Titanium dioxide, however, is among the most expensive materials that may be added to the slurry. Thus, despite the effectiveness of such material as a brightener, its use is limited and satisfactory replacements have been needed.

Kaolin clay has also been used as a filler in paper to improve brightness in the ultimate product. Generally, the kaolin clay is calcined and then suspended in an aqueous solution prior to being added to the furnish. The clay must be continuously agitated prior to entering the slurry or the solid particles begin to form sediment at the bottoms of the clay holding tanks. Although kaolin clay provides brightness, as well as opacity to the finished paper product, the relative difficulty of adding it to the slurry is a drawback.

When clay is added to the pulp slurry, the slurry needs additional chemicals. A retention aid is necessary to retain the clay in the sheet which will add extra cost to the sheet. Adding clay to the slurry will also have an adverse effect on drying the sheet of paper. The paper maker will slow the paper machine down to maximize the drying to make sure the sheet is dried which will increase the cost of the sheet. The clay also increases wear on the paper machine. This wear shows up in shorter life for some of the parts of the paper machine. The wire, felt, doctor blade and refiners especially, show wear when clay is used. With the increased abrasiveness of the clay down time is longer and more frequent. Such kaolin-containing products are described in U.S. Pat. Nos. 3,014,836 to Proctor, Jr. and 4,826,536 to Raythatha et at.

Hydrated aluminum silicate has also been employed as a clay substitute in the papermaking process. It has properties similar to kaolin clay and, thus, results in the same disadvantages when used to make paper.

Many compositions have been added to the slurry in an attempt to size the paper, i.e. add body to the paper and render the paper water repellent or waterproof. Most know sizes, such as those disclosed in U.S. Pat. No. 2,142,986 to Arnold, Jr. and U.S. Pat. No. 3,096,232 to Chapman, employ a type of wax. For example, Arnold, Jr. discloses that an emulsion of wax in a solution of deacetylated chitin, paraffin waxes, Japan wax, carnauba wax, higher aliphatic alcohols, or synthetic waxes may be employed as the waterproofing agent in a sizing composition. A softening agent such as aliphatic alcohols containing 12 to 20 carbons is also present in the composition of Arnold, Jr. Chapman discloses the use of paraffin waxes or water-insoluble derivatives of resins for producing aqueous wax emulsions with cationic modified starches.

Numerous sizing agents are know. Generally, the known sizes are cationic materials, particularly those used to size fabrics for the textile industry. Although the sizes' cationic nature increases their absorption by the fibers to which they are applied, their cationic nature generally prevents them from being used to the full extent possible in connection with a brightener and opacifying agent. It is well known in the art that although cationic materials often increase sizing, they reduce the brightness of the material to which they are applied. Because the addition of cationic sizing agents to paper generally reduces the brightness thereof, cationic sizes have not been heretofore preferred as a size for paper, and in particular, as a size for paper made from recycled pulp which often lacks the inherent brightness of paper made from virgin pulp.

SUMMARY OF THE INVENTION

It is an object of the present invention to provide a composition for adding to paper during the papermaking process so that the resulting paper has enhanced characteristics.

It is another object of the present invention to provide a composition that adds opacity to paper to which it is added.

Another object of the present invention is to provide a composition for opacifying a paper without significantly decreasing the coefficient of friction or brightness of the paper produced.

Still another object of the present invention is to provide a process for adding a composition to pulp slurry of cellulosic fibers in the papermaking process that will result in a paper having enhanced opacity.

Yet another object of the present invention is to provide a paper having the desirable characteristics of enhanced opacity.

Generally speaking, the present invention is directed to a composition used as an additive to the pulp slurry of cellulose fibers from which paper is formed, the process of making paper from the additive-containing slurry, and the paper made according to that process. The composition contains an alkyl bis (alkyl amido alkyl)-2-hydroxy alkyl ammonium alkyl salt. In addition the following may be added to the composition: an acid to adjust pH, an organic/or inorganic salt to adjust viscosity, and or a defoamer to control foam.

DETAILED DESCRIPTION OF THE INVENTION

The composition of this invention is added to the pulp slurry after the wood pulp has been bleached to remove lignin and other undesirables and de-inked, if recycled paper pulp is being used, but before the pulp enters into the headbox of a papermaking machine. The composition may be added alone, or in conjunction with other brighteners, opacifying agents, and sizes. For example, in one embodiment of the invention, the composition hereof may be added in conjunction with papermaking clays such as kaolin or in conjunction with a brightness and opacifying agent based on stearic acid diamide of amino ethyl ethanolamine.

The composition may be added to any pulp slurry of cellulose fibers to obtain the desired physical characteristics and is especially useful for enhancing . the characteristics of paper made from the recycled pulp of cellulose fibers. The amount of composition, as well as the amounts of each component in the composition, will vary depending on the characteristics and types of pulp slurry to which the composition is added. As is well known, different sources of wood pulp have different peculiarities that attribute to their ability to be brightened, made more opaque and more water resistant, and easily processed. For instance, some wood pulp requires a higher concentration of brightening and opacifying agents than others to produce a finished paper product having identical characteristics.

The composition employed in the present invention includes an alkyl bis (alkyl amido alkyl)-2-hydroxy alkyl ammonium alkyl salt. More specifically the composition comprises the salt of a diamido amine having the general formula:

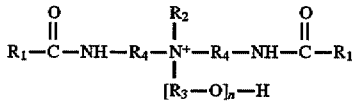

wherein each $R_1$ represents the same or different $C_4$–$C_{22}$ alkyl, alkenyl or hydroxy alkyl group, wherein each $R_4$ represents the same or different $C_2$–$C_6$ alkylene group, wherein $R_2$ represents a $C_1$–$C_4$ alkyl or a benzyl group, wherein $R_3$ represents a $C_2$–$C_4$ alkylene group and wherein n is a number from 1 to 20. In a preferred embodiment each $R_1$ represents the same or different $C_{11}$–$C_{19}$ alkyl group, wherein each $R_4$ represents the same or different $C_2$–$C_3$ alkylene group, wherein $R_2$ represents a $C_1$–$C_2$ alkyl group, wherein $R_3$ represents a $C_2$–$C_3$ alkylene group and wherein n is a number from 0 to 4.

The anion chosen for the salt of the diamido amine can be any suitable one based on the quarternation technique, including sulfates, chlorides or other halides. The preferred salt is a sulfate because these are less corrosive to metallic equipment, with the preferred sulfate being a $C_1$–$C_4$ alkyl sulfate, more preferably methyl or ethyl sulfate because of commercial availability.

A preferred composition contains methyl bis (tallowamido ethyl)-2-hydroxy ethyl ammonium methyl sulfate. This composition has been found to impart increased opacity to the resultant paper without significantly decreasing the coefficient of friction or brightness of the paper produced. The composition is generally added to the pulp of cellulose fibers at a level of 0.2 to 5% by weight d/d (dry on dry), preferably 0.5 to 2% by weight d/d on the cellulose fiber.

The make-up of the composition may be varied depending on the type of cellulose fibers from which the pulp slurry is made. In addition, the use of pulp which has been recycled from papers may require other adjustments to the composition, particularly when the recycled pulp is dark or otherwise discolored. All such adjustments to the composition may be easily made by one of ordinary skill in the art according to the invention disclosed herein.

The pulp to which the composition is added is made into a slurry using conventional techniques. The pulp may be bleached to remove unwanted pollutants such as lignins and de-inked if pulp made from recycled paper is used. The slurry is stored in holding tanks or fed to a papermaking machine, such as a Fourdrinier machine, in a conventional manner. The papermaking composition disclosed herein may be added either to the slurry when it is in the holding tank or may be added to the slurry as it moves along to the headbox of the papermaking machine. Preferably, the composition is applied onto the flowing pulp as it travels to the headbox.

When the slurry containing the composition reaches the headbox of the papermaking machine, paper is formed therefrom using conventional papermaking techniques and materials. The paper produced according to the present invention exhibits excellent characteristics of opaqueness, without significantly decreasing brightness or the coefficient of friction.

Moreover, the addition of the composition to the pulp slurry does not cause substantial negative effects on the slurry's movement through the papermaking process. Not decreasing the coefficient of friction is important as low coefficient causes crepe wrinkling and winder problems. Registration problems may also be caused on the printing press by a low coefficient of friction.

In a further embodiment of the present invention, other materials may be added in conjunction with the composition. For instance, the invention composition may be in addition to the kaolin clay so that the paper made therefrom exhibits increased opaqueness, and improved lubricity. Other additives which are well known in the art may also be added in conjunction with the composition disclosed herein.

The composition preferably contains a week acid to adjust the pH. The acid maintains an acidic pH preferably within the range of from about 3 to about 6. The acid acts as an aid to dispersion of the composition. Weak organic acids such as acetic acid or formic acid are especially preferred in the composition. Strong acids, of course, may be used to control the pH, but cost and safety considerations may restrict their use.

Preferably, a viscosity controlling agent such as a salt is added during production of the papermaking composition. Generally, the sodium salts and chloride salts are known viscosity controlling agents. Preferred salts include sodium acetate and sodium chloride. This component acts to reduce viscosity. The composition may further comprise a defoamer to control foam, and a biocide to control bacterial growth.

The present invention may be better understood by reference to the following examples.

EXAMPLE 1

A sample was prepared by dispersing 99 grams of methyl bis (tallowamido)-2-hydroxy ethyl ammonium methyl sulfate in 200 g. of water containing 2.2 g of acetic acid (84%) and 0.5 g of caustic soda 25% at 80 degrees centigrade. A 1 gm of sample was diluted with 99 gms of water to form 0.3% solids dispersion. The dispersion at a level of 8 ml. was mixed with a recycled newspaper pulp slurry containing 60 g. of solid pulp. Handsheets were prepared and tested against sheets prepared with no additive and with sheets prepared with an equivalent level of a comparative opacifier based on the stearic acid diamide of amino ethyl ethanolamine.

The hand sheets were prepared by pressing at 40 psig to squeeze out water and conditioned (TAPPI standard T402 OM-88) then calendared at 150° F. and 600 psi. The hand sheets were then tested for brightness and opacity on a Technobrite instrument with an average of five readings being taken. The coefficient of friction (C.O.F.) was measured by a slide angle tester Model TMI 3225.

| | No Additive | Sample | Comparative |
|---|---|---|---|
| Brightness | 57.09 | 56.77 | 58.86 |
| Opacity (ISO) | 92.79 | 95.20 | 93.55 |
| Opacity (TAPPI) | 87.50 | 91.25 | 88.92 |
| C.O.F. | .435 | .473 | .379 |

The product of the sample exhibited substantial increase in opacity with no significant decrease in brightness or coefficient of friction as compared to the no additive comparison. In fact an increase in c.o.f. was observed. The comparative exhibited a substantial decrease in the coefficient of friction.

What is claimed is:

1. A method of producing printing paper with enhanced opaqueness consisting essentially of the steps of:

providing a pulp slurry of cellulose fibers;

adding to said slurry a composition in an amount effective to enhance opaqueness of the paper produced comprising the salt of a hydroxylated diamido amine having the general formula:

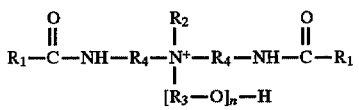

wherein each $R_1$ represents the same or different $C_4$–$C_{22}$ alkyl, alkenyl or hydroxy alkyl group, wherein each $R_4$ represents the same or different $C_2$–$C_6$ alkylene group, wherein $R_2$ represents a $C_1$–$C_4$ alkyl or a benzyl group, wherein $R_3$ represents a $C_2$–$C_4$ alkylene group and wherein n is a number from 0 to 20;

forming said slurry into said paper; and calendering the formed paper.

2. Method of claim 1 wherein the salt of the hydroxylated diamido amine has an anion selected from the group consisting of sulfate, chloride, and other halides.

3. Method of claim 1 wherein each $R_1$ represents the same or different $C_{11}$–$C_{19}$ alkyl group, wherein each $R_4$ represents the same or different $C_2$–$C_3$ alkylene group, wherein $R_2$ represents a $C_1$–$C_2$ alkyl group, wherein $R_3$ represents a $C_2$–$C_3$ alkylene group and wherein n is a number from 1 to 4.

4. Method of claim 1 wherein said composition is added to the pulp slurry at a level of 0.5 to 2% by weight d/d on cellulose fiber.

5. Method of claim 1 wherein said composition is added to the pulp slurry at a level of 0.2% to 5.0% by weight d/d on cellulose fiber.

6. Method of claim 1 wherein the composition is methyl bis (tallowamido ethyl)-2-hydroxy ethyl ammonium methyl sulfate.

7. Method of claim 6 wherein the composition further comprises an acid to maintain a pH from about 3 to about 6.

8. Method of claim 7 wherein the composition further comprises effective amounts of a defoamer to control foam, a biocide to control bacterial growth, and an organic or inorganic salt to control viscosity.

9. Method of claim 1 wherein the salt is a sulfate.

10. Method of claim 9 wherein the salt is a $C_1$–$C_4$ alkyl sulfate.

11. Method of claim 10 wherein the salt is a methyl sulfate.

12. Method of claim 10 wherein the salt is a methyl sulfate.

13. A printing paper product made from cellulose fibers having enhanced opaqueness, said product having a composition therein in an amount effective to enhance opaqueness of the paper produced consisting essentially of the salt of a hydroxylated diamido amine having the general formula:

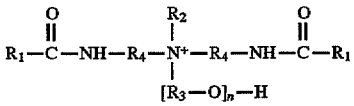

wherein each $R_1$ represents the same or different $C_4$–$C_{22}$ alkyl, alkenyl or hydroxy alkyl group, wherein each $R_4$ represents the same or different $C_2$–$C_6$ alkylene group, wherein $R_2$ represents a $C_1$–$C_4$ alkyl or a benzyl group, wherein $R_3$ represents a $C_2$–$C_4$ alkylene group and wherein n is a number from 0 to 20, and wherein said paper having been calendared.

14. Paper product of claim 13 wherein each $R_1$ represents the same or different $C_{11}$–$C_{19}$ alkyl group, wherein each $R_4$ represents the same or different $C_2$–$C_3$ alkylene group, wherein $R_2$ represents a $C_1$–$C_2$ alkyl group, wherein $R_3$ represents a $C_2$–$C_3$ alkylene group and wherein n is a number from 1 to 4.

15. Paper product of claim 13 wherein the composition is methyl bis (tallowamido ethyl)-2-hydroxy ethyl ammonium methyl sulfate.

16. Paper product of claim 13 wherein the composition is present at a level of 0.2% to 5.0% by weight d/d on fiber.

17. Paper product of claim 13 wherein the composition is present at a level of 0.5% to 2% by weight d/d on fiber.

* * * * *